US006250202B1

(12) United States Patent
Büttner et al.

(10) Patent No.: US 6,250,202 B1
(45) Date of Patent: Jun. 26, 2001

(54) HYDRAULIC CONTROL DEVICE

(75) Inventors: Peter Büttner; Armin Stellwagen, both of Lohr (DE)

(73) Assignee: Mannesmann Rexroth AG, Lohr am Main (DE)

( * ) Notice: Subject to any disclaimer, the term of this patent is extended or adjusted under 35 U.S.C. 154(b) by 0 days.

(21) Appl. No.: 09/402,577

(22) PCT Filed: Mar. 27, 1998

(86) PCT No.: PCT/EP98/01809

§ 371 Date: Oct. 1, 1999

§ 102(e) Date: Oct. 1, 1999

(87) PCT Pub. No.: WO98/45603

PCT Pub. Date: Oct. 15, 1998

(30) Foreign Application Priority Data

Apr. 5, 1997 (DE) ..... 197 14 141

(51) Int. Cl.[7] ..... F15B 11/08
(52) U.S. Cl. ..... 91/448; 91/459; 60/399
(58) Field of Search ..... 91/444, 448, 451, 91/459; 60/399, 403, 406

(56) References Cited

U.S. PATENT DOCUMENTS 3,976,097 * 8/1976 Brakel ..... 91/448
5,201,176 4/1993 Kazumi .

FOREIGN PATENT DOCUMENTS 3605113 8/1987 (DE) .
3710699 8/1988 (DE) .
4226893 2/1994 (DE) .
4324177 2/1994 (DE) .
4239109 6/1994 (DE) .
4320490 12/1994 (DE) .
4420459 1/1995 (DE) .
196 19 860 12/1996 (DE) .

* cited by examiner

*Primary Examiner*—Edward K. Look
*Assistant Examiner*—Michael Leslie
(74) *Attorney, Agent, or Firm*—Martin A. Farber

(57) ABSTRACT

A hydraulic control arrangement which has a directional control valve, a hydraulic pump and a two-way cartridge valve constructed as a seat valve. The directional control valve is connected to an inlet line and to a discharge line leading to a tank. Leading off from it is a load line leading to a hydraulic load. The hydraulic pump draws pressure medium from a tank and discharges it into the inlet line. The two-way cartridge valve is arranged in the inlet line and, in a closed position, isolates a second inlet line section leading off from the latter to the directional control valve from a first inlet line section running between the two-way valve and the hydraulic pump. A control piston of the two-way cartridge valve has an annular opening surface exposed to the pressure in the first inlet line section, a central circular opening surface exposed to the pressure in the second inlet line section, and a closing surface, which can be subjected to the pressure in the first inlet line section via a pilot valve in a first position of the latter and can be relieved from the pressure to the tank via the pilot valve in a second position of the latter. The two-way cartridge valve closes when an emergency off facility is triggered. To satisfy particularly high safety requirements, the invention makes provision for the second inlet line section to be relieved to the tank via the pilot valve in the first position of the latter.

2 Claims, 2 Drawing Sheets

X
Y
A
B
LS
P
T

HYDRAULIC CONTROL DEVICE

FIELD AND BACKGROUND OF THE INVENTION

The invention relates to a hydraulic control arrangement.

A hydraulic control arrangement known, for example, from DE 196 19 860 A1. This document describes a hydraulic control arrangement which is used on a die-casting machine and in which a directional control valve is used to shut off a load line leading from the latter to a pressure space of a hydraulic cylinder, to connect it to a discharge line leading to a tank or connect it to an inlet line. The inlet line is fed by a hydraulic pump which draws pressure medium from the tank. Arranged in the inlet line is a two-way cartridge valve designed as a seat valve, which allows a first inlet line section running between the hydraulic pump and the two-way cartridge valve to be isolated from a second inlet line section leading off from the two-way cartridge valve to the directional control valve. When the control piston of the two-way cartridge valve is seated on its seat, the two inlet line sections are isolated from one another. The valve used is a conventional two-way cartridge valve with a directional control function, the control piston of which has two opening surfaces acting in the opening direction, one of which is situated centrally on the control piston, corresponds in diameter to the seat diameter and is exposed to the pressure in the second inlet line section. The second opening surface is an annular surface, the inside diameter of which corresponds to the seat diameter and the outside diameter of which corresponds to the guiding diameter of the control piston and which can be subjected to the pressure in the first inlet line section. On the control piston there is also a closing surface which acts in the closing direction and which is exposed to the pressure in a rearward control space of the two-way cartridge valve. Together, the two opening surfaces are as large as the closing surface.

In a rest position, which it assumes under the action of a compression spring, a pilot valve connects the rearward control space to the first inlet line section. In this position of the pilot valve, the two-way cartridge valve, the control piston of which is usually additionally acted upon in the closing direction by a spring, cannot be opened by the pressure in the first inlet line section and by the pressure in the second inlet line section, which is normally not greater than the pressure in the first inlet line section. By energizing an electromagnet, the pilot valve can be switched to a position in which it connects the rearward control space at the control piston to the tank. The pressure prevailing in the first inlet line section and acting on the annular surface of the control piston can now raise the control piston from the seat against the, generally weak, closing spring and open the two-way cartridge valve.

It is possible to implement an emergency off facility with the valve described. In normal operation, the electromagnet of the pilot valve is excited and the two-way cartridge valve is open. If an emergency occurs, an electric switch can be actuated, for example, interrupting the power supply to the electrical systems, with the result that the electromagnet of the pilot valve is also separated from the power supply. The pilot valve moves into its rest position by virtue of the compression spring and connects the rearward control space at the control piston to the first inlet line section, with the result that the two-way cartridge valve closes and interrupts the flow of pressure medium to the directional control valve in a leak-free manner.

DE 44 20 459 A1 has disclosed a hydraulic control arrangement, based on the load-sensing principle, which, for emergencies, likewise has a valve by means of which a second inlet line section can be isolated from a first inlet line section. The isolating valve, which can be controlled by means of an electromagnetically actuable pilot valve, is clearly a spool valve which, in the rest position of the pilot valve, not only separates the two inlet line sections from one another but also connects the load-indicating line to the tank and hence relieves it. The pressure in the second inlet line section is also dissipated via the load-indicating line if the load-sensing directional control valve is in a working position to the side of its central position in which there is an aperture cross section between the second inlet line section and the load-indicating line.

DE 43 24 177 A1 has disclosed a hydraulic control arrangement, based on the load-sensing principle, in which, after an emergency-off signal has been triggered, an isolating valve isolates two inlet line sections from one another, shuts off the load-indicating line and connects a load-indicating port on the regulator of the variable-displacement pump to the tank. The isolating valve is again a spool valve.

SUMMARY OF THE INVENTION

It is the object of the invention to develop a hydraulic control arrangement of the above type in such a way that high safety requirements are met by simple means.

According to the invention, this object is achieved by virtue of the fact that, in a hydraulic control arrangement of the above type wherein the second inlet line section can be relieved to the tank via the pilot valve in the first position of the latter. This ensures that, once an emergency-off signal has been triggered, there is no longer any pressure in the second inlet line section in each position of the directional control valve. A force acting on the second opening surface, which attempts to raise the control piston from its seat, thus disappears, with the result that the control piston is pressed onto its seat by a large excess force and closes very tightly. No pressure medium is trapped in the second inlet line section, pressure which in adverse circumstances could be relieved to a load and lead to a dangerous small movement of the hydraulic load.

The increasing relief of the second opening surface from pressure with increasing closing displacement of the control piston leads to particularly rapid closure of the two-way cartridge valve and hence to an immediate stoppage of the flow of pressure medium to the directional control valve.

A hydraulic control arrangement according to the invention is particularly advantageous if, the directional control valve is hydraulically actuable and the control oil for actuation is taken from the second inlet line section. The pressure relief of the second inlet line section causes the control pressure to fall and there is thus nothing to oppose the return of the spool of the directional control valve into its rest position. Given electrohydraulic actuation of the directional control valve, there is no need to switch off the electric pilot control valves.

BRIEF DESCRIPTION OF THE DRAWINGS

A number of embodiment examples of a hydraulic control arrangement according to the invention are illustrated in the form of circuit diagrams in the drawings. The invention will now be explained in greater detail with reference to the figures in these drawings, in which.

DETAILED DESCRIPTION OF THE PREFERRED EMBODIMENTS

Figures 1, 2:
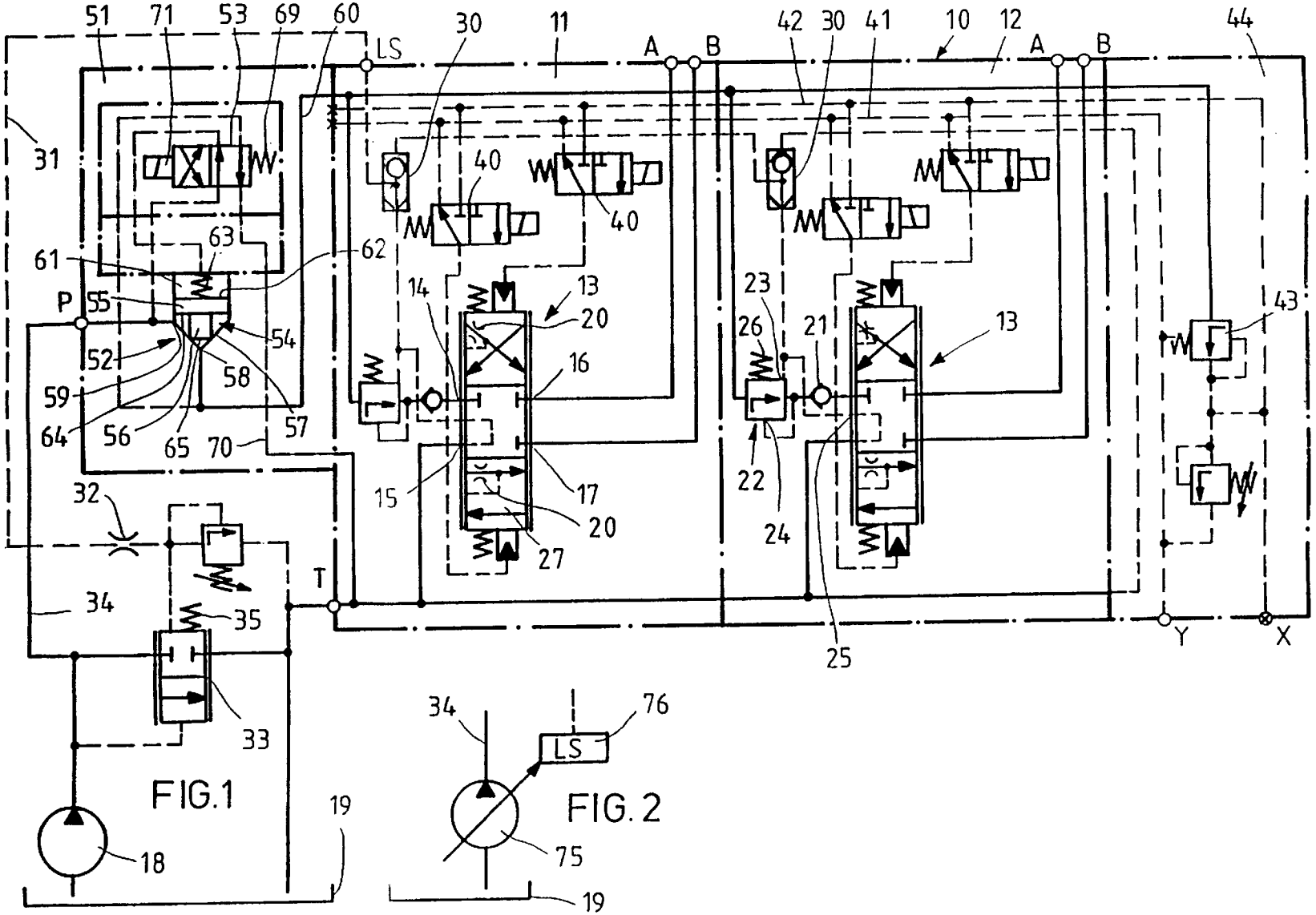
FIG. 1 shows a first embodiment example, which is based on the load-sensing principle, the source of pressure medium being in the form of a constant-displacement pump with a pressure compensator under load-sensing control in the bypass to the tank.
FIG. 2 shows a variable-displacement pump with a load-sensing controller, which can be used instead of the constant-displacement pump and the bypass pressure compensator shown in FIG. 1.

In the embodiment shown in FIG. 1, a control block 10 contains two directional control valve sections 11 and 12, each of which has a directional control valve 13 with an inlet chamber 14, to which pressure medium can flow from a hydraulic pump 18, a discharge chamber 15, which is connected to a tank 19, and two load chambers 16 and 17, which are connected by load lines to a double-acting hydraulic load, e.g. a differential cylinder, which is not shown specifically. The spool 27 of a directional control valve 13 can be displaced in opposite directions from a central position, in which the inlet chamber, the discharge chamber and the two load chambers are shut off from one another, into working positions in which a metering restrictor 20 between the inlet chamber 14 and load chamber 16 or load chamber 17 is open and the other load chamber respectively is connected to the discharge chamber 15. Connected upstream of the inlet chamber 14 are a load-holding valve 21 and an individual pressure compensator 22, the control piston of which is adjoined by two control spaces 23 and 24. Control space 23 is connected to a load-indicating chamber 25 of the directional control valve 13, and control space 24 is connected via the load-holding valve to the inlet chamber 14. In the central position of the spool 27, the load-indicating chamber 25 is relieved to the tank and, in a lateral working position, is in each case connected to the load chamber to which pressure medium is fed via the metering restrictor 20. The control piston of the pressure compensator 22 is loaded in the opening direction by a compression spring 26 and by the pressure prevailing in control space 23 and loaded in the closing direction by the pressure prevailing in control space 24.

A series of changeover valves 30 is used to apply the highest pressure prevailing in a control space 23, i.e. the highest load pressure in each case, to an output LS of the control block 10 and indicate it via a load-indicating line 31, in which there is a restrictor 32, to a bypass pressure compensator 33 which in each case allows enough of the pressure medium delivered by the hydraulic pump 18 to flow off to the tank 19 to ensure that the pump pressure established in an inlet-line section 34 which starts from the hydraulic pump 18 and via which pressure medium can be fed to the inlet chambers 14 of the directional control valves 13, is more than the indicated highest load pressure by a certain pressure difference.

The two directional control valves 13 can each be actuated electrohydraulically, for which purpose two electromagnetically operated pilot control valves 40 are integrated into each directional control valve section 11 and 12 respectively. In the rest position of a valve 40, an associated control space on the spool 27 of a directional control valve 13 is relieved to a leakage-oil passage 41 which passes through directional control valve sections 11 and 12.

By excitation of an electromagnet, one control space is connected to a control-pressure line 42, which likewise passes through directional control valve sections 11 and 12. The control oil is taken by means of a pressure-reducing valve 43 contained in an end plate 44 mounted on directional control valve section 12 from a passage which passes through the two directional control valve sections 11 and 12 and into the end plate 44 and which forms a second inlet line section 60 together with branch lines each connected to the inlets of the pressure compensator 22. The pressure-reducing valve 43 is, for example, set to a control pressure of 20 bar.

Connected to directional control valve section 11 is a safety block 51, which has a two-way cartridge valve 52, an associated pilot valve 53 and a series of pressure-medium passages. The control piston 54 of the two-way cartridge valve 52 is a differential piston which is guided axially by means of a piston section 55 and can come to rest axially on a seat 57 by means of a piston section 56 of smaller diameter in order to close an axial outlet 58. The first inlet line section 34 is connected to the radial inlet 59 and hence to the annular space around piston section 56. The second inlet line section 60, which is continued in directional control valve sections 11 and 12 as a through passage, starts from the axial outlet 58. The control piston 54 is acted upon in the closing direction by a force which is produced by a control pressure in a rearward control space 61 at a closing surface 62 equal in area to the cross-sectional area of the large piston section 55, and by the force of a relatively weak closing spring 63. A pressure in the first inlet line section 34 acts in the opening direction of the control piston 54 on an annular surface 64 and a pressure in the second inlet line section 60 acts on a circular surface 65 equal in area to the cross-sectional area of the small piston section 56 in the opening direction of control piston 54. The sum of the two areas 64 and 65 is equal to the size of surface 62.

The pilot valve 53 is a 4/2-way valve which, under the action of a compression spring 69, assumes a rest position, in which it connects the rearward control space 61 at the control piston 54 to the first inlet line section 34 and relieves the second inlet line section 60 to the tank 19 via a passage 70. By activation of an electromagnet 71, the pilot valve 53 can be switched to a position in which it connects a rearward control space 61 to the passage 70, i.e. relieves it to the tank and, since it is a standard component, connects the first inlet line section 34 to the second inlet line section 60.

In normal operation, the electromagnet 71 is excited, with the result that the pilot valve 53 assumes the second position. Since tank pressure prevails in the rearward control space 61, the pump pressure acting on the annular surface 64 is able to raise the control piston 54 from the seat, allowing pressure medium to pass from the first inlet line section 34 to the second inlet line section 60 virtually without loss of pressure. If all the directional control valves 13 are in their central position, tank pressure prevails in the load-indicating line 31 and the pressure compensator 33 adjusts the pressure in the inlet line sections to, for example, 20 bar, which is equivalent to the force of a compression spring 35 acting on the control piston of the pressure compensator in the closing direction together with the pressure prevailing in the load-indicating line 31. If one directional control valve is now switched to a working position, the load pressure is indicated to the pressure compensator 33, which closes the bypass to the tank 19 to such an extent that a pump pressure that is 20 bar above the load pressure builds up in the inlet line 34, 60. If both directional control valves are actuated, the highest load pressure is indicated to the pressure compensator 33.

The intention is that it should be possible, in a dangerous situation, to interrupt the flow of pressure medium from the hydraulic pump 18 to the directional control valves 13 from one or more points on a machine equipped with the hydraulic control arrangement shown, e.g. a multi-bucket vehicle. For this purpose, electrical switches (not shown specifically) are mounted at said points, these switches allowing connection of the electromagnet 71 of the pilot valve 53 to a power supply network in a rest position. The power supply to the electromagnet 71 is interrupted by operating one of the electrical switches, with the result that the pilot valve 53 moves into its rest position under the action of the compression spring 69. As a result, the rearward control space 61 is subjected to the pressure prevailing in the first inlet line section 34, causing the cartridge valve 52 to close. The second inlet line section 60 is relieved to the tank, and the pressure on the opening surface 65 thus falls rapidly during the closing operation. This leads to a rapid closing operation. Since the opening surface 65 is finally completely relieved of pressure, a large excess force in the closing direction acts on the control piston 54 and the control piston 54 thus rests firmly on its seat and shuts off the second inlet line section 60 from the first inlet line section 34 in a leak-free manner. Relieving the second inlet line section 60 also allows the control pressure in the control-pressure line 42 to fall, and the directional control valves thus return to the central position even if one pilot control valve 40 remains active.

In the central position of the directional control valve 13, the load-indicating line 31 is relieved to the tank, and the pump 18 thus delivers to the tank via the pressure compensator 33 at a low pressure of 20 bar.

In the embodiment shown in FIG. 2, a variable-displacement pump 75 with a load-sensing controller 76 is used instead of a constant-displacement pump 18 and a bypass pressure compensator 33. All the other components are the same as those in FIG. 1 and it is thus unnecessary to describe the embodiment in FIG. 2 further.

Figure 3:
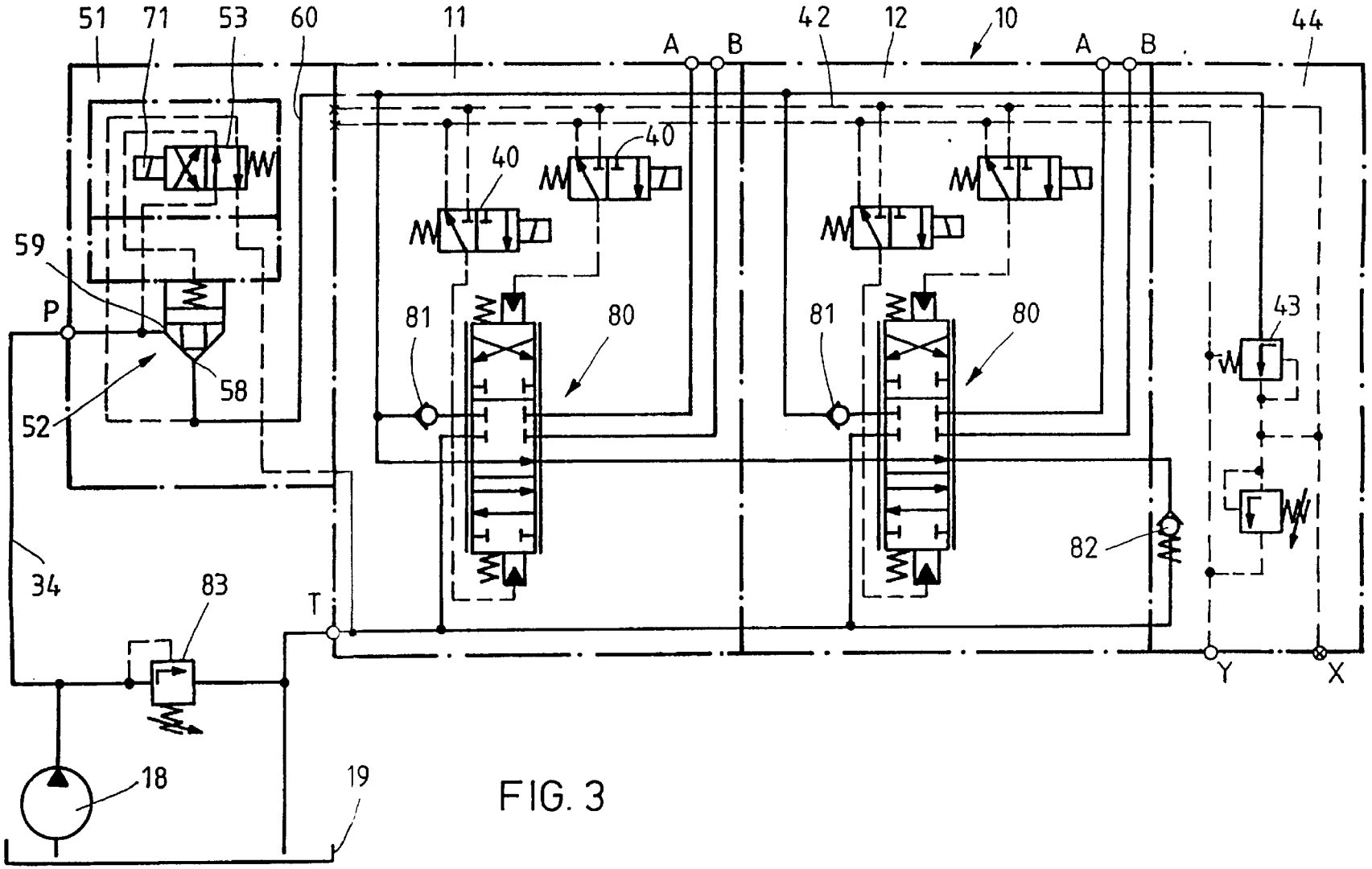
FIG. 3 shows a second embodiment example with a constant-displacement pump as the source of pressure medium and six-way directional control valves with a circulation passage.

The embodiment shown in FIG. 3 also has a control block 10 with two directional control valve sections 11 and 12 and an end plate 44. Here, each directional control valve section 11 contains a 6-way throttle valve 80 of a commonly known type of construction with a circulation passage and a load-holding valve 81. The directional control valves 80 can be activated electrohydraulically with the aid of pilot control valves 40. Control oil is taken by the pressure-reducing valve 43 accommodated in the end plate 44 from an inlet passage which extends through the directional control valve sections 11 and is part of the second inlet line section 60 and discharged into a control-pressure passage 42. To enable a control pressure to be built up at all starting from the central position of the directional control valve 80, the circulation passage is subjected to a preload by means of a nonreturn valve 82.

The same safety block 51 as in the embodiment shown in FIG. 1 is attached to directional control valve section 11 and attention is therefore drawn to the relevant description of FIG. 1.

A constant-displacement pump 18 protected by a pressure relief valve 83 is used as the source of pressure medium. The pump 18 draws pressure medium from a tank 19 and discharges it into a first inlet line section 34, which is connected to the radial inlet 59 of the cartridge valve 52. The second inlet line section 60 once again starts from axial outlet 58 of the cartridge valve 52.

In normal operation, the cartridge valve 52 is open, with the result that the pressure medium delivered by the hydraulic pump 18 is either fed back completely to the tank via the circulation passage or, after actuation of a directional control valve, passes completely or in part to a hydraulic load. In an emergency, the electromagnet 71 is de-energized by actuation of an electric switch, causing the pilot valve 53 to assume its rest position and the cartridge valve 52 to close. The second inlet line section 60 is isolated from the first inlet line section 34 and relieved to the tank. As in the case of the embodiment example shown in FIG. 1, the control pressure collapses. The directional control valves 80 move into their central position.

What is claimed is:

1. A hydraulic control arrangement with a directional control valve (13, 80) which is connected to an inlet line (34, 60) and to a discharge line leading to a tank (19) and from which a load line leads off to a hydraulic load, with a hydraulic pump (18, 75), by which pressure medium can be drawn from the tank (19) and discharged into the inlet line (34, 60), and with a two-way cartridge valve (52), which is constructed as a seat valve, is arranged in the inlet line (34, 60) and, in a closed position, isolates a second inlet line section (60) leading off from it to the directional control valve (13, 80) from a first inlet line section (34) running between it and the hydraulic pump (18, 75) and which has a control piston (54), with an annular opening surface (64) exposed to the pressure in the first inlet line section (34), with a central annular opening surface (65) exposed to the pressure in the second inlet line section (60), and with a closing surface (62), which can be subjected to the pressure in the first inlet line section (34) via a pilot valve (53) in a first position of the latter and can be relieved to the tank (19) via the pilot valve (53) in a second position of the latter, and wherein the second inlet line section (60) can be relieved to the tank (19) via the pilot valve (53) in the first position of the latter.

2. The hydraulic control arrangement as claimed in claim 1, wherein the directional control valve (13, 80) is hydraulically actuatable and the control oil for actuation is taken from the second inlet line section (60).

* * * * *